US005171130A

United States Patent [19]

Kume et al.

[11] Patent Number: 5,171,130

[45] Date of Patent: Dec. 15, 1992

[54] OIL-COOLED COMPRESSOR AND METHOD OF OPERATING SAME

[75] Inventors: Terumasa Kume; Kazuo Kubo; Masaki Matsukuma, all of Kobe; Tsutomu Horii, Kakogawa; Yoshitomo Yamamoto, Kobe, all of Japan

[73] Assignee: Kabushiki Kaisha Kobe Seiko Sho, Kobe, Japan

[21] Appl. No.: 731,324

[22] Filed: Jul. 17, 1991

[30] Foreign Application Priority Data

Aug. 31, 1990 [JP] Japan ..... 2-232186
May 15, 1991 [JP] Japan ..... 3-110246

[51] Int. Cl.[5] ..... F04B 39/04

[52] U.S. Cl. ..... 417/228; 184/6.16; 418/97; 418/100

[58] Field of Search ..... 417/228; 418/DIG. 1, 418/97, 98, 100; 184/6.16, 6.21, 6.24

[56] References Cited

U.S. PATENT DOCUMENTS

| | | | |
|---|---|---|---|
| 1,494,875 | 5/1924 | Yeomans | 417/228 |
| 2,470,655 | 5/1949 | Shaw | 418/100 |
| 2,701,684 | 2/1955 | Hirsch | 418/98 |
| 3,260,444 | 7/1966 | Williams | 417/228 |
| 3,395,856 | 8/1968 | Clark | 417/228 |
| 3,429,502 | 2/1969 | Lundvik | 417/228 |
| 3,448,916 | 6/1969 | Fraser | 417/228 |
| 3,751,936 | 8/1973 | Simard | 417/228 |
| 3,848,422 | 11/1974 | Schibbye | 418/DIG. 1 |
| 3,850,009 | 11/1974 | Villadsen | 418/97 |
| 3,859,815 | 1/1975 | Kasahara | 418/97 |
| 3,905,729 | 9/1975 | Bauer | 417/228 |
| 3,945,464 | 3/1976 | Sato | 417/228 |
| 4,063,855 | 12/1977 | Paul | 417/228 |
| 4,070,166 | 1/1978 | Emanuelsson | 418/DIG. 1 |
| 4,394,113 | 7/1983 | Bammet | 418/98 |
| 4,605,357 | 8/1986 | Keith | 417/228 |
| 5,028,220 | 7/1991 | Holdsworth | 418/DIG. 1 |
| 5,033,944 | 7/1991 | Lassota | 418/DIG. 1 |
| 5,066,202 | 11/1991 | Berges | 417/228 |
| 5,087,178 | 2/1992 | Wells | 418/DIG. 1 |

*Primary Examiner*—Richard A. Bertsch
*Assistant Examiner*—Peter Korytnyk
*Attorney, Agent, or Firm*—Oblon, Spivak, McClelland, Maier & Neustadt

[57] ABSTRACT

An oil cooled compressor includes a compressor body having a low pressure suction passage and a high pressure discharge passage. An oil tank is mounted to the discharge passage such that oil and drain water separated from a compressed gas in the discharge passage collect in the oil tank with water at a lowermost part of the oil tank. A drain water passage separate from a compressed gas discharge passage and an oil discharge passage, connects the lowermost part of the oil tank with a portion of the compressor body which is substantially at the low pressure. Drain water is thereby evaporated from the oil tank and returned to the compressor body.

4 Claims, 2 Drawing Sheets

OIL-COOLED COMPRESSOR AND METHOD OF OPERATING SAME

BACKGROUND OF THE INVENTION

1. Field of the Invention

This invention relates to an oil-cooled compressor adapted to cool a gas being compressed with a lubricating oil.

2. Description of the Related Art

An oil-cooled compressor designed to lead a lubricating oil to a gas compression space for the purpose of cooling a compressed gas, lubricating a rotor section, and sealing a clearance in the compression space has been widely known. In this type of compressor, an oil tank is mounted within a discharge passage, where the compressed gas discharged together with the lubricating oil is delivered after separation from the lubricating oil, and the lubricating oil thus separated is dripped downwardly to be collected. After being thus collected in the lower part, the lubricating oil is sent back into the compressor body for recirculation.

In the known equipment described above, water in the lubricating oil accumulated in the oil tank gradually separates, gathering beneath this lubricating oil. If this undesirable water separation is left uncorrected, water thus gathering, not the lubricating oil, will be supplied to lubrication points in the compressor body.

It is, therefore, necessary to drain the oil tank, that is to remove water from the oil tank prior to the day's operation. This draining is a troublesome operation.

SUMMARY OF THE INVENTION

The present invention has as an object to solve the problem mentioned above, and also has as an object the provision of an oil-cooled compressor which requires on draining of the oil tank.

In order to solve the problem, a first feature of the invention comprises connecting the lowermost part of the oil tan provided in the discharge passage in the compressor body to some point from the suction passage in the compressor body to a space immediately after gas trapping, i.e., at a portion of the compressor body which is substantially at the suction pressure.

A second feature of the invention comprises connecting the lowermost part of the oil tank mounted in the discharge passage in the compressor to some point between the suction passage in the compressor and a space immediately after gas trapping, and is designed so as to run the compressor, if not operating, for a fixed period of time when drain water accumulated in the lower part of the oil tank has reached a specific value.

Furthermore, because of the aforesaid constitution of the second and third features of the invention, the drain water in the oil will be fully evaporated with the heat of the compressed gas even when, for example, the compressor is intermittently operated, for a short period of time as compared with the dwell period, at a low ambient atmospheric temperature, at a high humidity, and at a high discharge pressure at which the drain water in the oil is hard to evaporate.

The foregoing objects and other objects, as well as the actual construction and operation of the method according to the present invention, will become more apparent and understandable from the following detailed description thereof, when read in connection with the accompanying drawings.

DESCRIPTION OF THE PREFERRED EMBODIMENTS

Hereinafter an exemplary embodiment of an oil-cooled compressor according to the present invention will be explained with reference to the drawings.

Figure 1:
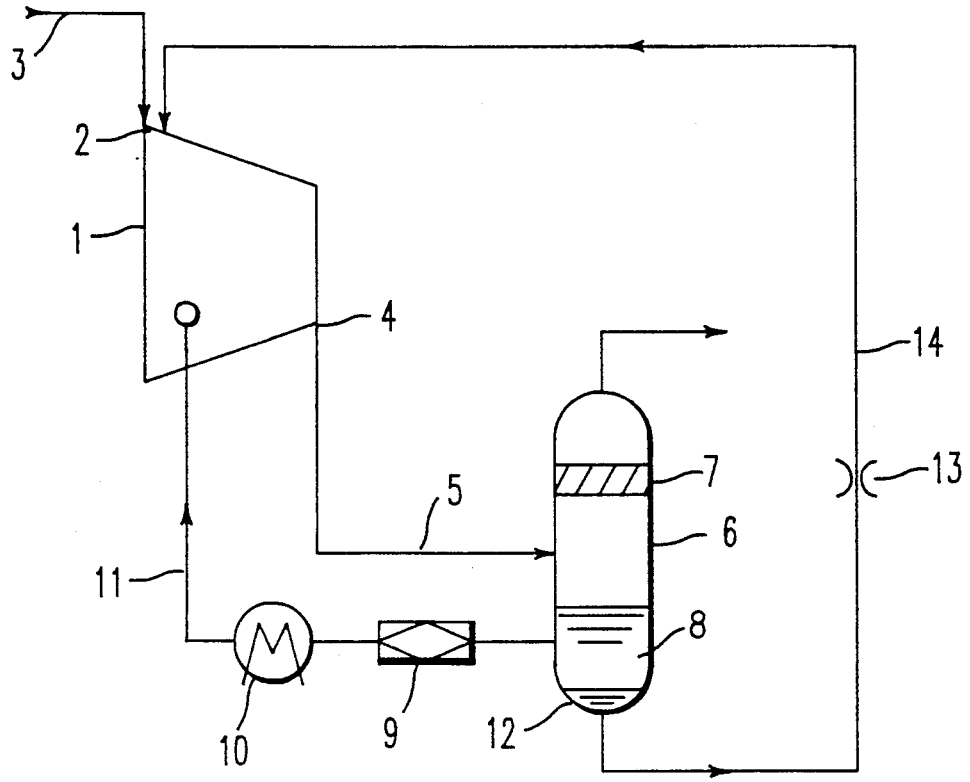
FIG. 1 is a general block diagram of an oil-cooled compressor according to the first feature of the invention.

FIG. 1 shows an oil-cooled compressor according to the first embodiment of the invention, in which a suction passage 3 is connected to an inlet port 2 of a compressor body 1, a discharge passage 5 extends from an outlet port 4, and in this discharge passage 5 is installed an oil tank 6. In the upper part within this oil tank 6 is mounted an oil separation element 7. The lower part forms an oil reservoir 8, from which a lubricating oil circulation passage 11 extends to lubrication points such as bearings, seals, and a compression space, which are not illustrated in the compressor body 1, through an oil filter 9 and an oil cooler 10. In addition, a drain water passage 14 is provided extending from the lowermost part of the oil reservoir 8 to the inlet port 2 via an orifice 13 for discharging water 12 accumulated in the bottom of the oil reservoir 8.

As a rotor, which is not illustrated, in the compressor body 1 rotates, a gas is drawn in from the suction passage 3 through the inlet port 2. After being compresses together with the lubricating oil supplied through the lubricating oil circulation passage 11 for gas cooling purposes, the gas is discharged to the discharge passage 5 through the outlet port 4. The compressed gas thus discharged goes together with the lubricating oil into the oil tank 6, in which the compressed gas is separated from the lubricating oil by means of the oil separation element 7, being sent to the discharge passage 5 extending upwardly. The separated lubricating oil drips downwardly, being collected and temporarily held in the oil reservoir 8. Furthermore, the lubricating oil under a discharge pressure in the oil tank 6 is supplied to the aforementioned lubrication points in the compressor body 1 via the oil filter 9 and the oil cooler 10, and then is discharged together with the compressed gas through the outlet port 4, hereafter being recirculated as described above.

On the other hand, water is gradually separated from the lubricating oil in the oil reservoir 8, accumulating as drain water in the lower part of the oil reservoir 8. The drain water is led to the inlet port 2 o the low-pressure side by the drain water passage 14 under the discharge pressure of the lubricating oil, while being restrained from abruptly flowing by means of the orifice 13, and is then evaporated by heat generated at the time of gas compression, thus being discharged as a compressed gas out into the discharge passage 5. Since the water automatically separated from the lubricating oil is led to the inlet port 2, a drain water discharge operation for the oil tank 6 can be dispensed with.

In the above-described embodiment, the drain water passage 14 is connected to the inlet port 2, but it is to be understood that the present invention is not limited to such an application and this drain water passage 14 may be connected to some point between the suction passage 3 and a space immediately after gas trapping in the compressor body 1.

Figure 2:
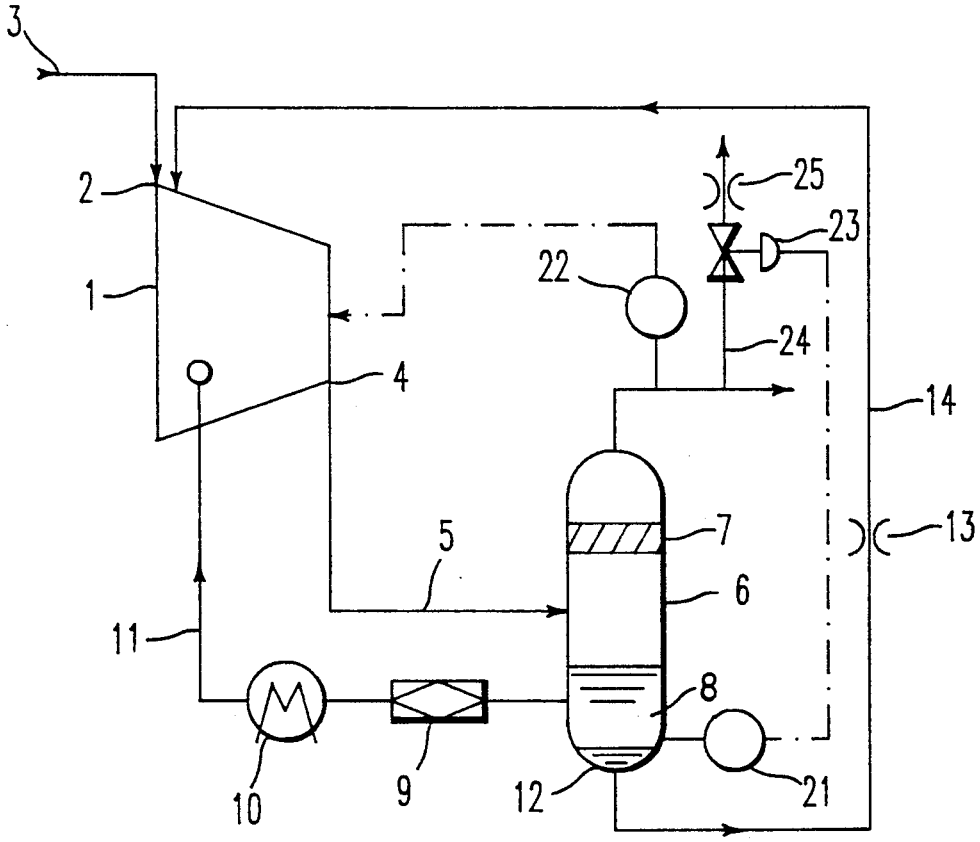
FIG. 2 is a general block diagram of an oil-cooled compressor according to the second feature of the invention.

FIG. 2 shows an oil-cooled compressor to which the operating method according to the second embodiment of the invention is applied. This compressor is substantially the same as the equipment shown in FIG. 1 except for the use of a drain water sensing system whereby the compressor 1 is operated when the drain water in the oil tank 6 has exceeded a specific level. In this drawing, the same reference numerals are used for the corresponding parts, which will not be explained.

The oil-cooled compressor of the present embodiment is formed by providing a pressure switch 22, a solenoid on-off valve 23 and a gas discharge passage 24 having an orifice 25 in the discharge passage 5 connected with the outlet side of the oil tank 6, and further by providing a drain water sensing means 21 in the lower part of the oil tank 6.

The pressure switch 22 produces a signal for stopping the operation of the compressor 1 when a pressure sensed in the discharge passage 5 exceeds a specific value. The drain water sensing means 21 produces a signal for opening the solenoid on-off valve 23 when the drain water in the oil tank 6 exceeds a specific quantity, or a permissible quantity, and, in other cases, produces a signal for closing the solenoid on-off valve 23.

Next, a method of operating the compressor of the above-mentioned constitution will be explained.

When a value sensed by the drain water sensing means 21 is smaller than a specific value, the compressor operates similar to the compressor according to the first embodiment.

In the meantime, when this sensed value exceeds the specific value, the solenoid on-off valve 23 is opened by a signal from the drain water sensing means 21 to allow the gas to flow from the discharge passage 5 out into the gas discharge passage 24 side while being throttled by the orifice 25 to lower the discharge pressure. As a result, the compressor 1, if in a stopped state, will be operated by a signal from the pressure switch 22. If, in this state, the compressor of such a design is used under severe operating conditions, for example intermittent operation for a short period of operation as compared with its dwell period, at a low ambient temperature, at a high humidity, and with a high discharge pressure from the compressor so that the drain water in the oil is hard to evaporate, the compressor can operate for an appropriate time interval, producing compressed gas heat for complete evaporation of the drain water in the oil.

Figure 3:
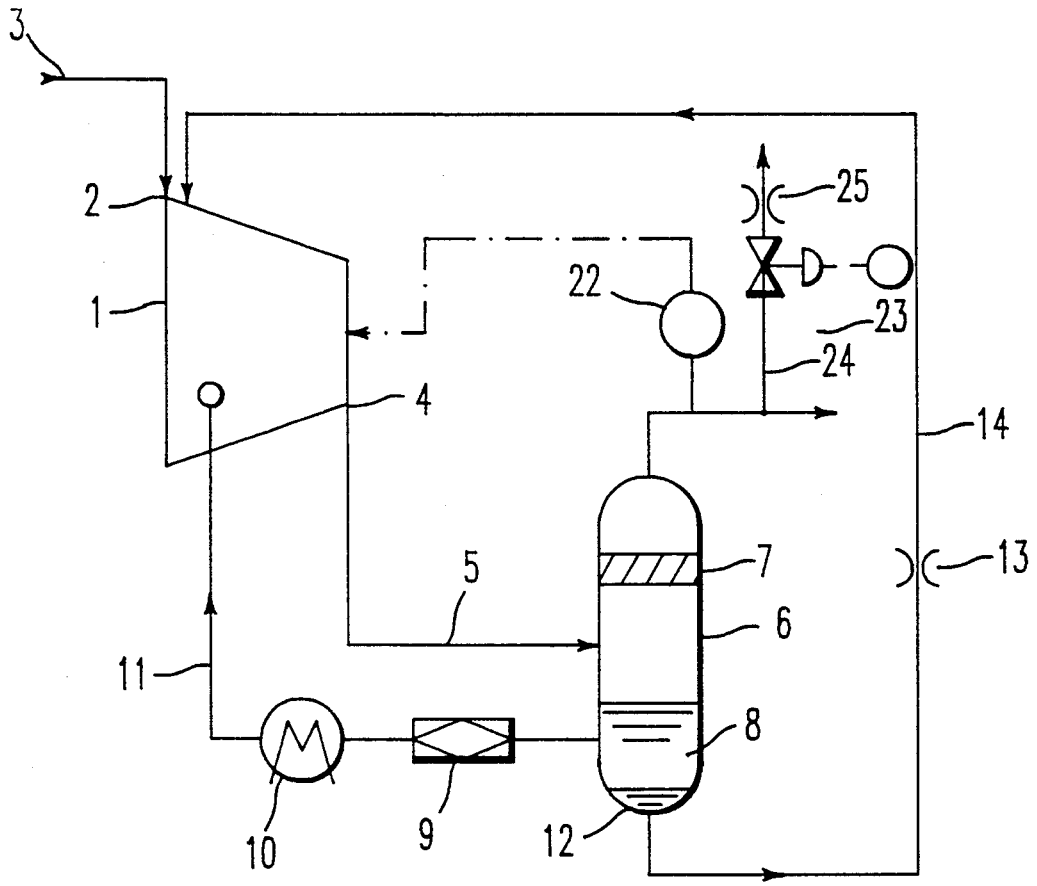
FIG. 3 is a general block diagram of an oil-cooled compressor according to the third feature of the invention.

FIG. 3 shows an oil-cooled compressor to which the method of operation according to the third embodiment of the invention is applied, and is substantially the same as the equipment shown in FIG. 2 except for the use of a timer 26 in place of the drain water sensing means 21. The same reference numerals are used for corresponding parts, which will not be explained.

According to the method of operating the oil-cooled compressor of the third embodiment of the invention, the timer 26 is used to regularly open the solenoid on-off valve 23 to operate the compressor at an appropriate time interval, thereby generating compressed gas heat for fully evaporating drain water contained in the oil.

In the present embodiment the use of the timer 26 is described as an example, but it is to be understood that the invention is not limited to this equipment described above and may include equipment which regularly manually opens the solenoid on-off valve 23.

As is apparent from the explanation given above, according to the first embodiment of the invention, the lowermost part of the oil tank mounted in the discharge passage of the compressor is connected to some point between the suction passage of the compressor body and a space immediately after gas trapping.

Water separated from the lubricating oil in the oil tank and gathering at the bottom of the oil tank is automatically led into the compressor, where it is evaporated by heat generated by gas compression, then being discharged in the form of a compressed gas. Consequently, the oil-cooled compressor has such an advantage that the oil tank requires no drain water discharge operation.

Furthermore, according to the second embodiment of the invention, the lowermost part of the oil tank mounted in the discharge passage of the compressor is connected to some point between the suction passage of the compressor and the space immediately after gas trapping, and also the compressor, when not operating, will be operated for a fixed period of time when the drain water accumulated in the lower part of the oil tank has reached a specific value.

Furthermore, according to the third embodiment of the invention, the lowermost part of the oil tank mounted in the discharge passage of the compressor is connected to some point between the suction passage of the compressor and the space immediately after gas trapping, and the compressor, when not operating, will be run regularly for a fixed period of time.

The oil-cooled compressor, therefore, has the advantage that even under severe operating conditions such as when the compressor is operated for a shorter period than the dwell time, at a low ambient temperature and at a high humidity, and with a high discharge pressure from the compressor so that the drain water in the oil is hard to evaporate, the drain water in the oil can be evaporated completely with the heat of the compressed gas, thereby obtaining the improved effect under any severe operating condition.

The present invention has been described in detail with particular reference to preferred embodiments thereof but it will be understood that variations and modifications can be effected within the spirit and scope of the invention.

What is claimed is:

1. An oil cooled compressor comprising:

a compressor body having a low pressure suction passage and a high pressure discharge passage;

an oil tank mounted in said discharge passage such that oil and drain water separated from a compressed gas in said discharge passage collect in said oil tank with water at a lowermost part of said oil tank; and an oil discharge passage connected to said oil tank;

a compressed gas discharge passage connected to said oil tank;

a drain water passage separate from said compressed gas discharge passage and oil discharge passage, connecting the lowermost part of the oil tank with a portion of the compressor body which is substantially at the low pressure, whereby drain water from the oil tank is evaporated.

2. The oil cooled compressor of claim 1 including a flow restrictor in said drain water passage.

3. The oil cooled compressor of claim 1 including:

means for detecting that the drain water in the lowermost part of the oil tank has reached a specific value; and means for operating the compressor for a fixed period of time after the specific value has been detected.

4. The oil cooled compressor of claim 1 including means for regularly operating the compressor for a fixed period of time.

* * * * *